United States Patent [19]

vanManen

[11] 4,027,810

[45] June 7, 1977

[54] SEALING PLUNGER FOR CARTRIDGE

[75] Inventor: Dick T. vanManen, Canandaigua, N.Y.

[73] Assignee: Voplex Corporation, Pittsford, N.Y.

[22] Filed: Jan. 27, 1976

[21] Appl. No.: 652,829

[52] U.S. Cl. ..... 222/327; 220/93

[51] Int. Cl.[2] ..... B27G 11/02

[58] Field of Search ..... 222/325, 326, 327, 386, 222/386.5, 389, 93; 128/218 P

[56] References Cited

UNITED STATES PATENTS

| | | | |
|---|---|---|---|
| 2,126,424 | 8/1938 | Tear | 222/386 |
| 3,140,078 | 7/1964 | Krahe et al. | 222/327 X |
| 3,164,303 | 1/1965 | Trautmann | 222/386 X |
| 3,201,003 | 8/1965 | Wark et al. | 222/386 X |

*Primary Examiner*—Robert B. Reeves
*Assistant Examiner*—Joseph J. Rolla
*Attorney, Agent, or Firm*—Stonebraker, Shepard & Stephens

[57] ABSTRACT

A cartridge plunger has a generally cup-shaped body molded of a relatively rigid resin material, and a seal material is joined to the body and molded of a substantially softer and more resilient resin material. The body has an annular wall closely spaced from the inner surface of the cartridge, and the seal material extends around the outside of the annular wall which presses the seal material tightly against the inner surface of the cartridge when the plunger is in the cartridge. The seal material can also extend rearwardly of the plunger body and around the rearward edge of the cartridge for an additional seal when the plunger is initially seated in the cartridge. The softness and conformability of the sealing material forms a better sealing engagement with the cartridge to protect the contents from moisture and air.

8 Claims, 3 Drawing Figures

SEALING PLUNGER FOR CARTRIDGE

BACKGROUND OF THE INVENTION

Some cartridge contents for sealing and caulking purposes are moisture activated or subject to deterioration on contact with air or moisture, so that a good seal between the plunger and the cylindrical wall of the cartridge has long been recognized as important in the art. The sealing problem is further complicated by thermal expansion and contraction of the contents requiring a slightly movable plunger. There have been many suggestions for ways of making improved seals between the plunger and the cartridge, but all of them involve problems of expense, assembly, compatibility with existing equipment, or inability to provide a satisfactory seal.

The invention involves recognition of a way of making a different seal for a plunger to accomplish substantially improved sealing with minimal expense and without requiring additional parts, additional assembly steps, or substantial modifications of existing equipment for loading and dispensing from cartridges. The invention aims at the best possible seal for the lowest possible cost with minimum disruption of the status quo.

SUMMARY OF THE INVENTION

The inventive sealing plunger has a generally cup-shaped body molded of resin material rigid enough to provide structural support for the plunger. A seal material is joined to the body and is molded of resin material substantially softer and more resilient than the resin material of the body. The body has an annular wall closely spaced from the inner surface of the cartridge, and the seal material extends around the outside of the annular wall which presses the seal material tightly against the inner surface of the cartridge when the plunger is in the cartridge. The seal material also preferably has annular ridges that are compressed against the inner surface of the cartridge, and the seal material can extend over the rearward edge of the annular wall of the plunger body and also around the rearward edge of the cartridge when the plunger is initially seated in the cartridge.

Alternatively, the annular wall of the plunger body can closely engage the inner surface of the cartridge directly, and the seal material can be joined to the annular wall and extend around and engage the inner and outer surfaces of the rearward region of the cartridge when the plunger is initially seated in the cartridge.

DRAWINGS

FIG. 1 is a half-cross-sectional, elevational view of a preferred embodiment of the inventive plunger; and FIGS. 2 and 3 are fragmentary, cross-sectional views of other preferred embodiments of the inventive plunger.

DETAILED DESCRIPTION

Figure 1:
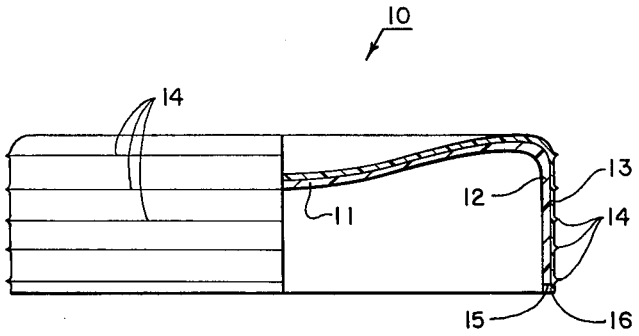

Plunger 10 of FIG. 1 has a cup-shaped body 11 molded of a relatively rigid resin material to provide structural support for plunger 10. Body 11 has a generally cylindrical, annular wall 12 dimensioned to be closely spaced from the inner surface of a generally cylindrical cartridge when plunger 10 is seated in the cartridge. The material of body 11 can be any of several generally known resin materials, such as high-density polyethylene or polypropylene in a relatively rigid or hard form to have a durometer of about Shore D60–70, for example.

Surrounding the outside of annular wall 12 is a sealing material 13 also formed of a molded resin, but preferably substantially softer and more resilient than the resin of body 11. Suitable resins for sealing material 13 include ethylene vinyl acetate copolymer, low density polyethylene, thermoplastic rubber, plasticized polyvinyl chloride, and ethylene ethyl acrylate copolymer, for example. Sealing material 13 is preferably formed with annular ridges 14 extending around the periphery of plunger 10, and ridges 14 are compressed tightly against the inner surface of the cartridge from the outward pressure provided by wall 12. This deforms and flattens ridges 14 to provide an excellent seal, and the compressibility and conformability of sealing resin 13 provides a better seal than can be achieved by forming plunger 10 of a single resin material.

Sealing material 13 preferably extends around the rearward edge 15 of body 11 in a thickened ring 16 helping to secure sealing material 13 to body 11. Rear edge 15 of body 11 can also be formed with an inward facing chamfer 17 as shown in FIG. 2 so that ring 16 can extend to an interlock 18 engaging chamfer 17 in a ring around the inner periphery of edge 15 to increase the security of the attachment of sealing material 13 to body 11.

Figure 2:
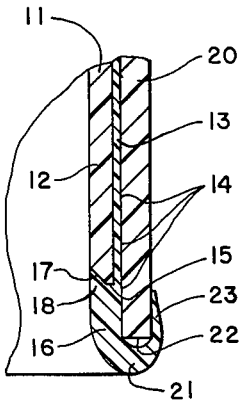

The embodiment of FIG. 2 also shows sealing material 13 compressed against the wall 20 of a cartridge with sufficient pressure to flatten ridges 14. The FIG. 2 embodiment also shows addition of a lip 21 extending rearwardly from ring 16, and wrapping around the rearward edge 22 of wall 20 to terminate in a free edge 23 engaging the outer surface of wall 20. Lip 21 is shaped to press against both the inner and outer surfaces of wall 20 at the rear end of the cartridge to provide an additional seal. Material 13 is flexible enough so that lip 21 allows movement of the plunger with expansion and contraction of the contents of the cartridge, and when the plunger is advanced to dispense the cartridge contents, free edge 23 is flexible enough to move around rear edge 22 and follow body 11 into the cartridge.

Figure 3:
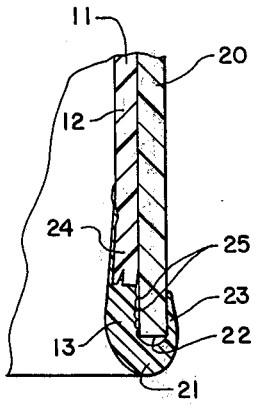

An alternative sealing arrangement is shown in FIG. 3 where annular wall 12 engages and pressed directly against cartridge wall 20 and sealing material 13 is joined to the rearward region 24 of wall 12 and extends around the rearward edge 22 of wall 20 in a flexible lip 21 terminating in a free end 23 as described relative to FIG. 2. Preferably, a plurality of annular ridges 25 are formed to press against the inner surface of wall 20 with a pressure enhanced by the adjacent rigidity of annular wall 12. Lip 21 provides an additional seal protecting the contents of the cartridges before use, and lip 21 and free edge 23 are flexible enough to move around rearward edge 22 of wall 20 and follow body 11 into the cartridge as the plunger is advanced.

Those skilled in the art will appreciate the various materials and configurations possible in making an improved seal by using two different resin materials of varying hardness according to the invention. Configurations for sealing ridges, lips, and anchorages to help secure the two resins together can be varied considerably once the basic principle of the invention is understood.

What is claimed is:

1. A sealing plunger for a generally cylindrical cartridge, said plunger comprising:

a. a generally cup-shaped body molded of resin material rigid enough to provide structural support for said plunger;

b. said body having an annular wall with a generally cylindrical outer surface providing a substantial wall area closely and uniformly spaced from the inner surface of said cartridge when said plunger is in said cartridge;

c. seal material adjoined to said body and molded of resin material substantially softer and more resilient than said resin material of said body;

d. said seal material extending in a thin layer around all of said outer surface of said annular wall;

e. said seal material having a resin-to-resin bond with said outer surface of said annular wall; and f. said annular wall compressing said seal material tightly against said inner surface of said cartridge to conform said seal material to said inner surface when said plunger is in said cartridge.

2. The plunger of claim 1 wherein said seal material is formed with annular ridges that are compressed against said inner surface, and said seal material extends over the rearward edge of said annular wall.

3. The plunger of claim 1 wherein said seal material extends axially rearward and radially outward around the rearward end of said cartridge when said plunger is initially seated in said cartridge.

4. The plunger of claim 1 wherein said seal material extends radially inward from said outer surface over the rearward end of said annular wall.

5. The plunger of claim 4 wherein said seal material extends axially rearward and radially outward around the rearward end of said cartridge when said plunger is intially seated in said cartridge.

6. A sealing plunger for a cartridge, said plunger comprising:

a. a generally cup-shaped body molded of relatively rigid resin material;

b. said body having an annular wall closely engaging the inner surface of said cartridge when said plunger is in said cartridge;

c. seal material joined to said annular wall and molded of resin material substantially softer and more resilient than said resin material of said body;

d. said seal material having a resin-to-resin bond with said annular wall;

e. said seal material extending axially rearward of said annular wall when said plunger is initially seated in said cartridge; and f. the portion of said seal material extending rearward of said annular wall being shaped for extending around the rearward end of said cartridge and closely engaging the outer surface of a rearward region of said cartridge when said plunger is initially seated in said cartridge.

7. The plunger of claim 6 wherein said seal material is flexible enough to move from said rearward region of said cartridge and follow said body into said cartridge as the contents of said cartridge are dispensed.

8. The plunger of claim 6 wherein said rearward extending portion of said seal material also engages the inner surface of said rearward region of said cartridge.

* * * * *